US006940082B2

(12) United States Patent
Grilliot et al.

(10) Patent No.: US 6,940,082 B2
(45) Date of Patent: Sep. 6, 2005

(54) PROTECTIVE ITEM FOR FIREFIGHTER OR FOR EMERGENCY RESCUE WORKER AND OPAQUE TO HAZARDOUS RADIATION

(75) Inventors: William L. Grilliot, Dayton, OH (US); Mary I. Grilliot, Dayton, OH (US); Jeffrey O. Stull, Austin, TX (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 213 days.

(21) Appl. No.: 10/358,928

(22) Filed: Feb. 5, 2003

(65) Prior Publication Data

US 2004/0149938 A1 Aug. 5, 2004

(51) Int. Cl.[7] ..... G21F 3/00
(52) U.S. Cl. ..... 250/516.1; 250/515.1
(58) Field of Search ..... 250/516.1, 515.1, 250/519.1

(56) References Cited

U.S. PATENT DOCUMENTS

| | | | | | |
|---|---|---|---|---|---|
| 3,883,749 | A | * | 5/1975 | Whittaker et al. | 250/516.1 |
| 4,996,981 | A | * | 3/1991 | Elenewski et al. | 128/201.15 |
| 5,022,099 | A | * | 6/1991 | Walton | 2/410 |
| 6,066,856 | A | * | 5/2000 | Fishman | 250/515.1 |
| 6,281,515 | B1 | | 8/2001 | DeMeo et al. | |
| 6,310,355 | B1 | * | 10/2001 | Cadwalader | 250/515.1 |
| 6,459,091 | B1 | | 10/2002 | DeMeo et al. | |
| 2003/0010939 | A1 | | 1/2003 | DeMeo et al. | |

* cited by examiner

*Primary Examiner*—Kiet T. Nguyen
(74) *Attorney, Agent, or Firm*—Wood, Phillips, Katz, Clark & Mortimer

(57) ABSTRACT

A protective item for a firefighter or for an emergency rescue worker has an outer shell and an inner liner, wherein at least one of the outer shell and the inner liner is opaque to hazardous radiation. The inner liner may have plural layers, one being opaque to hazardous radiation, another providing a moisture and chemical barrier, and another providing thermal insulation.

2 Claims, 1 Drawing Sheet

PROTECTIVE ITEM FOR FIREFIGHTER OR FOR EMERGENCY RESCUE WORKER AND OPAQUE TO HAZARDOUS RADIATION

TECHNICAL FIELD OF THE INVENTION

This invention pertains to a protective item, such as a protective garment, an item of protective footwear, or a protective glove, for a firefighter or for an emergency rescue worker. This invention contemplates that the protective item is opaque to hazardous radiation.

BACKGROUND OF THE INVENTION

Commonly, whether civilian or military, a firefighter or an emergency rescue worker wears various protective items, such as protective garments, protective footwear, and protective gloves. Here, protective garments may include a protective coat, protective trousers, protective overalls, or protective coveralls and protective footwear may include protective boots. Commonly, each protective item has an outer shell and an inner liner, which may have plural layers, such as a layer providing a moisture barrier and a layer providing thermal insulation.

As exemplified in U.S. Pat. No. 6,281,515 and No. 6,459,091, the disclosures of which are incorporated herein by reference, and in United States Patent Application Publication No. US 2003/0010939 A1, the disclosure of which is incorporated herein by reference, lightweight materials have been developed, from which lightweight garments, lightweight blankets, and lightweight tents can be made and which are opaque to hazardous radiation, such as x-rays. Those materials are described in those disclosures as being radiopaque.

SUMMARY OF THE INVENTION

This invention provides a protective item for a firefighter or for an emergency rescue worker. The protective item has an outer shell and an inner liner. At least one of the outer shell and the inner liner is opaque to hazardous radiation.

Preferably, the inner liner is opaque to hazardous radiation. Preferably, moreover, the inner liner has plural layers, one of which is opaque to hazardous radiation. Another of those layers may provide a moisture barrier. Another of those layers may provide thermal insulation.

DETAILED DESCRIPTION OF THE ILLUSTRATED EMBODIMENT

Figure 1:
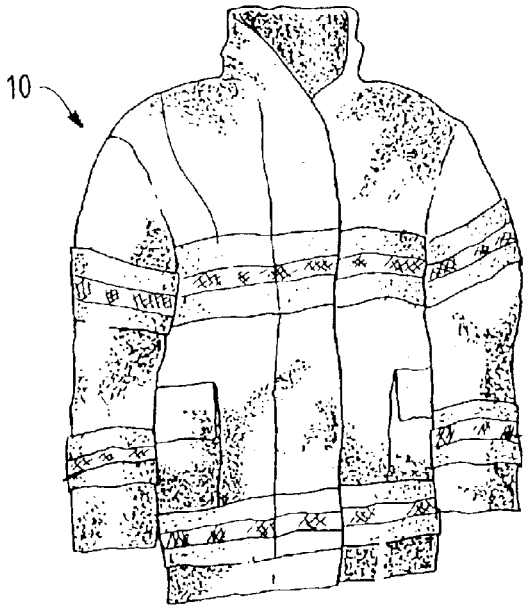
FIG. 1 is a perspective view of a protective coat for a firefighter, as an example of a protective item embodying this invention.
Figure 2:
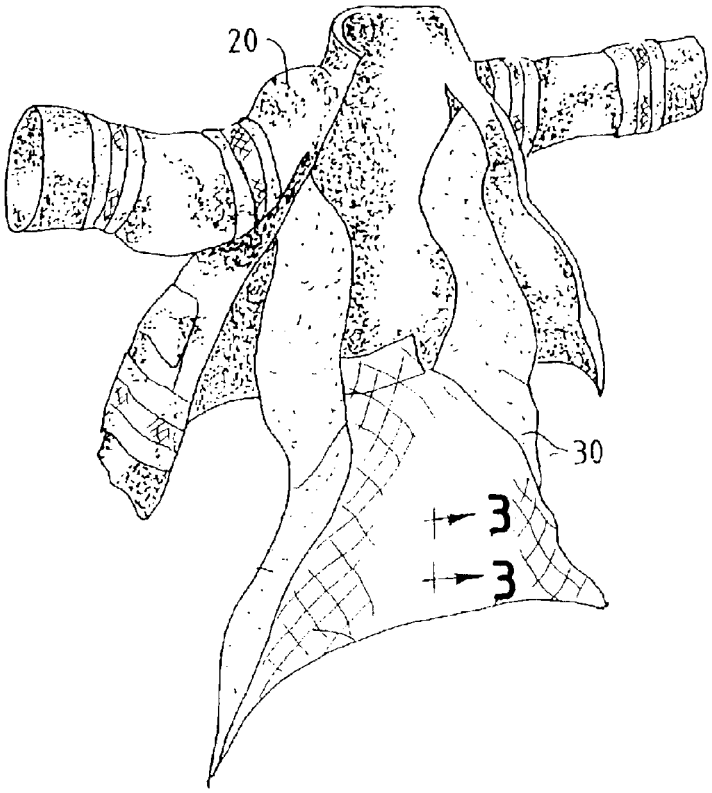
FIG. 2 is a perspective view of the protective coat, as opened to show that the protective coat has an outer shell and an inner liner.
Figure 3:
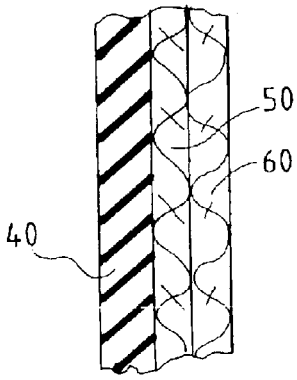
FIG. 3 is a sectional view of the inner liner, as taken along line 3—3 of FIG. 1, in a direction indicated by arrows.

As illustrated, a protective coat 10 for a firefighter exemplifies a protective item embodying this invention. As contemplated by this invention, the protective coat 10 is opaque to hazardous radiation. The protective coat 10 has an outer shell 20, which conforms to National Fire Protection Association (NFPA) standards for outer shells for protective garments for firefighters, and an inner liner 30, which conforms to National Fire Protection Association (NFPA) standards for inner liners for protective garments for firefighters and which is opaque to hazardous radiation.

The inner liner 30 has an outer layer 40, which provides a moisture and chemical barrier, an intermediate layer 50, which provides thermal insulation, and an inner layer 60, which is opaque to hazardous radiation. The outer layer 40 and the intermediate layer 50 are conventional in inner liners for protective garments for firefighters.

Preferably, the inner layer 60 is made from one of the materials described as radiopaque in U.S. Pat. No. 6,281,515 and No. 6,459,091 and United States Patent Application Publication No. US 2003/0010939 A1, supra.

Alternatively, the inner layer 40 is omitted and one of the materials described as radiopaque in U.S. Pat. No. 6,281,515 and No. 6,459,091 and United States Patent Application Publication No. US 2003/0010939 A1, supra, is used as one of the materials of the layer 40 providing a moisture and chemical barrier and/or as one of the materials of the layer 50 providing thermal insulation.

Rather than in the protective coat 10, this invention may be also embodied in protective garments of other types, such trousers, overalls, or coveralls, in protective footwear, such as boots, or in protective gloves. When this invention is embodied in an item of protective footwear, such as a boot, or in a protective glove, the outer shell may be a leather, rubber, or fabric shell.

What is claimed is:

1. A protective item being a coat, trousers, overalls, or coveralls for a firefighter or for an emergency rescue worker, being a glove for a firefighter or for an emergency rescue worker, or being a boot for a firefighter or for an emergency rescue worker, wherein the protective item has an outer shell, which provides one layer, wherein the protective item has a liner, which has plural layers, wherein a first of those layers provides a moisture and chemical barrier, wherein a second of those layers provides thermal insulation, and wherein a third of those layers is opaque to hazardous radiation.

2. A protective item being a coat, trousers, overalls, or coveralls for a firefighter or for an emergency rescue worker, being a glove for a firefighter or for an emergency rescue worker, or being a boot for a firefighter or for an emergency rescue worker, wherein the protective item has an outer shell, which provides one layer, wherein the protective item has a liner, which has plural layers, wherein a first of those layers provides a moisture and chemical barrier, wherein a second of those layers provides thermal insulation, and wherein a third of those layers is innermost layer of the liner and is opaque to hazardous radiation.

* * * * *